US009016644B2

(12) United States Patent
Reese

(10) Patent No.: US 9,016,644 B2
(45) Date of Patent: Apr. 28, 2015

(54) ATTACHMENT DEVICE FOR A CHILDREN'S ACCESSORY

(75) Inventor: Bradford Reese, Alpharetta, GA (US)

(73) Assignee: Kids II, Inc., Atlanta, GA (US)

( * ) Notice: Subject to any disclaimer, the term of this patent is extended or adjusted under 35 U.S.C. 154(b) by 427 days.

(21) Appl. No.: 13/224,161

(22) Filed: Sep. 1, 2011

(65) Prior Publication Data

US 2012/0049023 A1 Mar. 1, 2012

Related U.S. Application Data

(60) Provisional application No. 61/379,184, filed on Sep. 1, 2010.

(51) Int. Cl.

| | |
|---|---|
| ***A47B 96/06*** | (2006.01) |
| ***A63H 33/00*** | (2006.01) |
| ***A63H 5/00*** | (2006.01) |

(52) U.S. Cl.

CPC ..... *A63H 33/006* (2013.01); *A63H 5/00* (2013.01)

(58) Field of Classification Search

CPC ..... A63H 33/006; A63H 5/00
USPC ..... 248/220.21, 220.22, 221.11, 222.11, 248/224.7, 228.8, 229.17, 230.8, 297.31
See application file for complete search history.

(56) References Cited

U.S. PATENT DOCUMENTS

| | | | | |
|---|---|---|---|---|
| 3,978,610 | A | 9/1976 | Stubbmann | |
| 4,573,654 | A | 3/1986 | Nottingham | |
| 4,786,081 | A * | 11/1988 | Schmidt | 280/801.2 |
| 4,904,220 | A | 2/1990 | Williams et al. | |
| 5,352,145 | A | 10/1994 | Raiffe et al. | |
| 5,672,088 | A | 9/1997 | Chininis | |
| 5,673,889 | A * | 10/1997 | DeValcourt | 248/229.17 |
| 5,797,569 | A * | 8/1998 | Simons | 248/187.1 |
| 6,113,455 | A | 9/2000 | Whelan et al. | |
| 6,413,141 | B1 | 7/2002 | Putney | |
| 6,658,678 | B2 | 12/2003 | Hotaling et al. | |
| 6,769,952 | B1 | 8/2004 | Drosendahl et al. | |
| 7,037,170 | B2 | 5/2006 | Pacella et al. | |
| 7,172,486 | B2 | 2/2007 | Drosendahl et al. | |
| 7,278,616 | B2 | 10/2007 | Kahan | |
| 7,387,285 | B2 | 6/2008 | Thomason et al. | |
| 7,458,114 | B2 | 12/2008 | Troutman | |
| 8,424,820 | B2 * | 4/2013 | Cotirla et al. | 248/228.1 |

(Continued)

FOREIGN PATENT DOCUMENTS

WO WO 2010/028253 3/2010

OTHER PUBLICATIONS

Invitation to Pay Additional Fees and Partial Search Report dated Nov. 22, 2011 for PCT Application No. PCT/US2011/050240.
International Search Report and Written Opinion of the International Searching Authority dated Jan. 26, 2012 for corresponding application No. PCT/US2011/050240.
International Preliminary Examining Authority, Written Opinion for International Application No. PCT/US2011/050240, mailed Dec. 10, 2012, 6 pages, European Patent Office, The Netherlands.

(Continued)

*Primary Examiner* — Gwendolyn W. Baxter
(74) *Attorney, Agent, or Firm* — Alston & Bird LLP

(57) ABSTRACT

An attachment device is configured for attaching a children's accessory, such as a mobile or audio-visual device, to a children's support device, such as a crib or play yard. The attachment device may include a strap connected to a movable member that permits the position of the strap to be adjusted in order to secure the device to support structures having a variety of cross-sectional shapes and sizes. In addition, the attachment device may include one or more coupling features configured for removably securing the attachment device to a children's accessory.

29 Claims, 9 Drawing Sheets

(56) References Cited

U.S. PATENT DOCUMENTS

| | | | | |
|---|---|---|---|---|
| 2006/0267394 | A1* | 11/2006 | David et al. | 297/468 |
| 2010/0037440 | A1 | 2/2010 | May et al. | |
| 2010/0193655 | A1 | 8/2010 | Fleischman | |
| 2010/0323581 | A1 | 12/2010 | Goszewski et al. | |

OTHER PUBLICATIONS

Instruction Manual for Fisher-Price Mobile, model No. T4265, product released in 2010, 14 pp., available at http://service.mattel.com/instruction_sheets/T4265pr-0920.pdf.

* cited by examiner

ATTACHMENT DEVICE FOR A CHILDREN'S ACCESSORY

CROSS-REFERENCE TO RELATED APPLICATIONS

This application claims priority from provisional U.S. Application No. 61/379,184 entitled "Crib Mobile Attachment Device," which was filed on Sep. 1, 2010 and is herein incorporated by reference.

BACKGROUND OF THE INVENTION

1. Field of the Invention

Various embodiments of the present invention described herein generally relate to accessories for a children's support device and, in particular, to an attachment device for attaching such accessories to a children's support device, such as a crib.

2. Description of Related Art

Children's accessories are commonly attached to children's support devices to provide various functions. In particular, accessories such as mobiles and audio-visual devices are often attached to a children's crib in order to entertain a child positioned in the crib. Existing children's accessories include a variety of attachment devices configured for attaching an accessory to a support structure of a crib frame (e.g., a section of crib railing).

For example, certain existing accessories include a flexible clip configured to clip around a portion of a child support device's frame. Such a clip is described in U.S. Pat. No. 7,278,616, which discloses a pinwheel accessory that includes a semi-cylindrical sleeve configured to clip around a section of tubing (e.g., a tubular rail of a children's crib frame). The walls of the sleeve are configured to flex outwardly in order receive and wrap around the tubing, thereby securing the accessory to the tubing. However, clip attachment devices of this type are only configured for attachment to cylindrical members and are not well suited for attachment to structures of varying sizes and shapes.

Other existing accessories include adjustable clamping mechanisms configured to engage a crib's horizontal and vertical rails. For example, U.S. Pat. No. 7,387,285 discloses a clamp assembly configured to support an accessory, such as a mobile. The clamp assembly includes a ledge configured to rest on the upper surface of a crib frame's top rail, a threaded shaft configured to fit between vertical slats extending downwardly from the crib's top rail, and a clamping nut configured to be screwed onto the threaded shaft in order to clamp the assembly to the vertical slats and secure the assembly to the crib frame. However, clamping mechanisms of this type provide limited adjustability and can only be secured to cribs having vertical slats sized and positioned to be compatible with the clamp's shaft and clamping nut.

In other existing accessories, straps disposed on an accessory housing are configured to be secured around a crib rail. For example, U.S. Patent Publication No. 2010/0323581 discloses a children's mobile accessory supported by a housing having a pair of upper and lower straps. The straps are configured to be wrapped around a crib rail and secured to one another with a buckle in order to attach the mobile's housing to the crib rail. However, the position of these straps with respect to the housing cannot be adjusted and, as such, provide limited stability when attached to certain crib railings.

Accordingly, there remains a need in the art for an improved accessory attachment device configured to secure a children's accessory to various support structures having differing shapes and sizes. There is a further need for such an accessory to provide enhanced stability when attached to these various support structures. In addition, existing accessory attachment devices are disposed on individual children's accessories and are not configured to be removed or used with other children's accessories. Accordingly, there also remains a need for a removable accessory attachment device adapted for use with a variety of children's accessories.

BRIEF SUMMARY OF THE INVENTION

Various embodiments of the present invention are directed to an attachment device for attaching a children's accessory to a support structure. According to various embodiments, the attachment device comprises a frame and at least one strap operatively connected to the frame at a first connection position and a second connection position. The portion of the strap positioned between the first connection position and the second connection position defines an effective portion of the strap having an effective length. The attachment device further comprises at least one fastener connected to the strap, where the at least one fastener is configured for releasably securing the effective portion of the strap around a portion of the support structure in order to attach the attachment device to the support structure. The attachment device further comprises at least one movable member connected to the frame and connected to the strap. The position of the movable member generally defines the location of the first connection position, and the movable member is configured for being moved along at least a portion of the frame to a user-preferred position with respect to the support structure. The strap's effective length can be adjusted to effectively attach the children's accessory to the support structure.

Various other embodiments of the present invention are directed to an attachment device for attaching a children's accessory to a support structure. According to various embodiments, the attachment device comprises a frame, at least one strap operatively connected to the frame, and at least one fastener connected to the strap. The at least one fastener is configured for releasably securing the strap around a portion of the support structure in order to attach the frame to the support structure. In addition, the frame defines one or more coupling features configured for engaging a children's accessory and removably securing the children's accessory to the attachment device.

According various other embodiments, a children's accessory and attachment device are configured for attachment to a support structure. In such embodiments, the children's accessory includes a housing, while the attachment device is configured for being attached to the support structure and for receiving and supporting the housing. The attachment device may comprise a frame, at least one strap operatively connected to the frame, and at least one fastener connected to the strap. The at least one fastener is configured for releasably securing an effective portion of the strap around a portion of the support structure in order to attach the attachment device to the support structure. In addition, the frame defines one or more coupling features configured for engaging the housing and removably securing the children's accessory to the attachment device. In certain embodiments, the children's accessory can be removed from the attachment device and replaced with another children's accessory of a different type, the attachment device configured for receiving and securing both types of children's accessories.

BRIEF DESCRIPTION OF THE SEVERAL VIEWS OF THE DRAWING(S)

Reference will now be made to the accompanying drawings, which are not necessarily drawn to scale, and wherein.

DETAILED DESCRIPTION OF THE INVENTION

The present invention will now be described more fully hereinafter with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Various embodiments of the present invention are directed to an attachment device configured for attaching a children's accessory (e.g., a mobile or audio-visual device) to a children's support device (e.g., a crib, play yard, stroller, bouncer, swing, or the like). According to various embodiments, the accessory attachment device generally comprises a frame, at least one strap connected to the frame, and at least one fastener connected to the strap. The frame is generally configured for engaging a support structure on a children's support device (e.g., the railing of a crib frame), while the strap is configured for being secured around a portion of the support structure in order to secure the frame to the support structure.

As described in greater detail herein, certain embodiments of the accessory attachment device include a movable member slidably connected to the frame and connected to the device's strap. According to various embodiments, the movable member permits the position of the strap to be adjusted in relation to the frame in order to permit the strap to be tightly secured around support structures having a variety of cross-sectional shapes and sizes. In addition, certain embodiments of the accessory attachment device include one or more coupling features configured for removably securing the attachment device to a children's accessory. In other embodiments, the features of the attachment device may be disposed directly on the housing of a children's accessory.

Accessory Attachment Device

Figure 1:
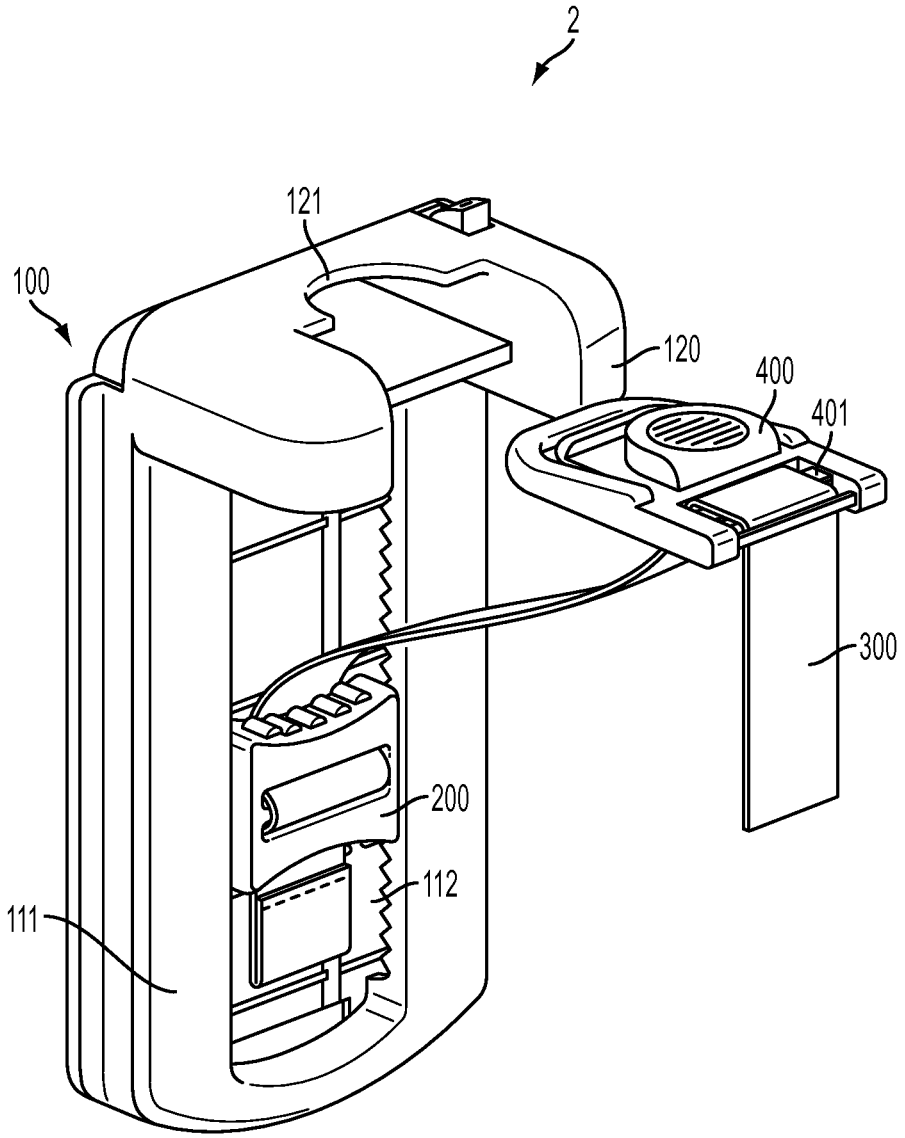
FIG. 1 shows a front perspective view of an attachment device for a children's accessory according to one embodiment of the present invention.

FIG. 1 illustrates a children's accessory attachment device 2 according to one embodiment. In the illustrated embodiment, the attachment device 2 comprises a frame 100, a movable member 200 slidably connected to the frame 100, a strap 300 connected at one end to the movable member 200, and a fastener 400 connected to an opposite end of the strap 300. According to various embodiments, the frame 100 is a generally rigid member configured for being attached to a support structure via the strap 300 and fastener 400. In addition, the frame 100 is configured for receiving and supporting a removable children's accessory.

As shown in FIG. 1, the frame 100 includes a front wall 111 and an upper shelf 120. The front wall 111 is substantially flat and defines a central channel 112 oriented longitudinally along the front wall 111. As described in greater detail below, the channel 112 is configured to guide the movable member 200 as it is repositioned on the frame 100 and secured in a user-preferred position. In the illustrated embodiment, the shelf 120 extends outwardly from an upper portion of frame 100 and defines a mating fastener 121, which is configured to engage the fastener 400.

Figure 2:
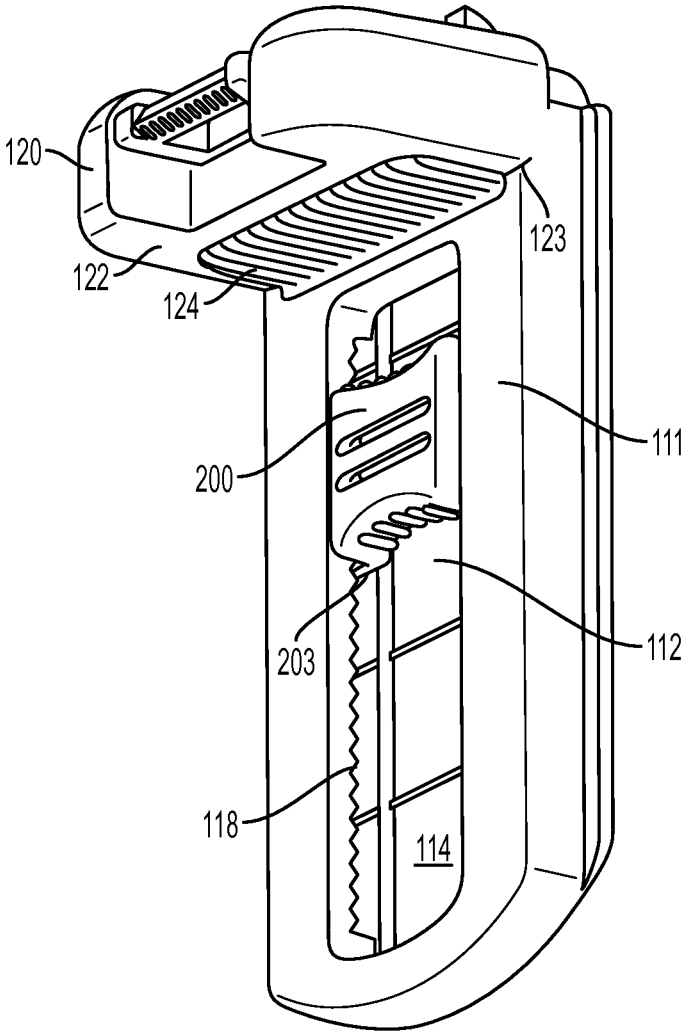
FIG. 2 shows another front perspective view of the attachment device of FIG. 1.

FIG. 2 illustrates the frame 100 from a lower vantage point. As shown in FIG. 2, the shelf 120 defines a substantially flat bottom wall 122 that intersects the frame's front wall 111 and forms a corner 123 extending across the width of the frame 100. In the illustrated embodiment, the shelf's bottom wall 122 is oriented perpendicular to the frame's front wall 111 such that the corner 123 defines a 90 degree angle. In addition, the shelf's bottom wall 122 includes a gripping surface 124 comprising a ribbed rubber strip. However, according to various other embodiments, the gripping surface 124 may comprise other materials exhibiting advantageous surface friction properties, such as low-durometer elastomers (e.g., Santoprene™ and other thermoplastic elastomers). As described in greater detail below, the frame 100 is configured for engaging a support structure proximate the corner 123 such that at least portions of the frame's front wall 111 and the shelf's gripping surface 124 are in contact with the support structure.

The various features of the frame's frontal area—such as the front wall 111, shelf 120, and gripping surface 124—are configured for engaging a support structure to which the attachment device 2 is secured (e.g., a crib railing). Similarly, the rear area of the frame 100 includes coupling features configured for engaging and securing a children's accessory (e.g., a mobile or audio-visual device).

Figure 3:
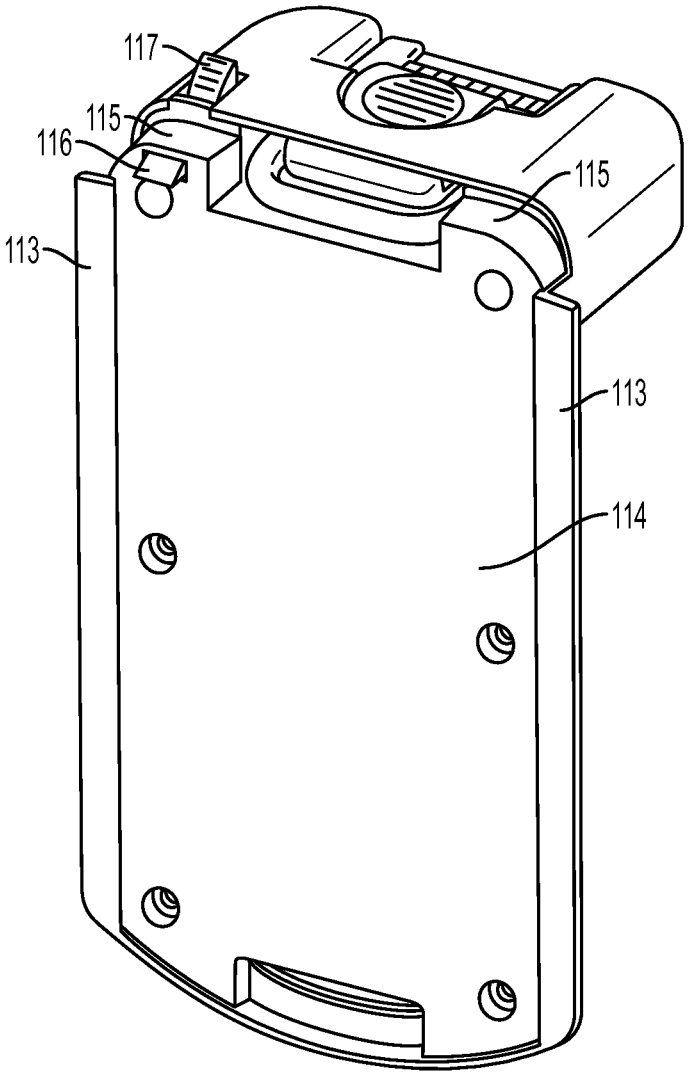
FIG. 3 shows a rear perspective view of the attachment device of FIG. 1.

FIG. 3 provides a rear view of the frame 100. As shown in FIG. 3, the frame 100 includes a rear wall 114 and a pair of lateral flanges 113. In the illustrated embodiment, the lateral flanges 113 extend outwardly along the length of the frame's lateral sides. The rear wall 114 is substantially flat and defined between the flanges 113. In addition, an upper portion of the rear wall 114 defines a pair of landing surfaces 115. As described in greater detail below, the flanges 113 are configured to couple the attachment device 2 to a children's accessory by being inserted within vertical channels defined on the housing of the children's accessory. Likewise, the landing surfaces 115 are configured to support a coupled children's accessory by engaging a projected portion of the accessory's housing and providing vertical support for the accessory.

The frame 100 also includes an accessory locking mechanism. As shown in FIG. 3, the locking mechanism comprises a spring-loaded finger 116 having a user-accessible release member 117. As described in greater detail below, the spring-loaded finger 116 is biased toward an extended position (shown in FIG. 3). As a children's accessory is lowered onto the attachment device 2, the children's accessory causes the finger 116 to remain in a retracted position until it is able to extend into a recessed area of the accessory and lock the accessory in place. A user may then use the release member 117 to retract the finger 116 and release the accessory.

Figure 4:
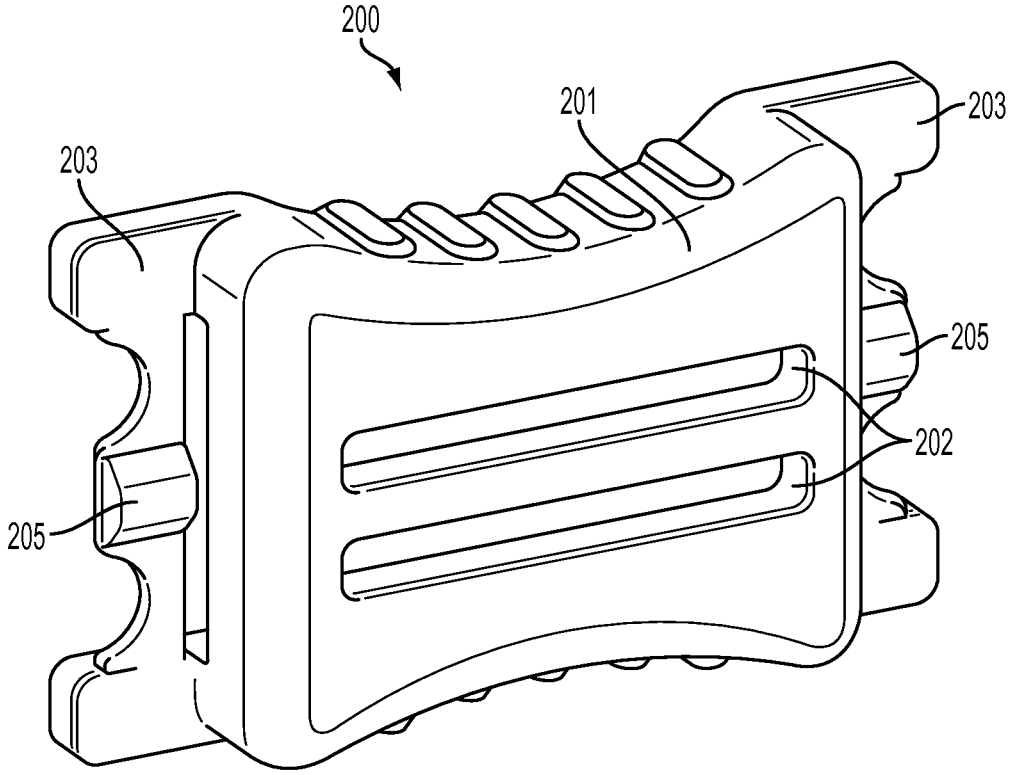
FIG. 4 shows a perspective view of a movable member according to one embodiment of the present invention.

According to various embodiments, the movable member 200 is connected to a portion of the strap 300 and configured to enable a user to adjust the position of the strap 300 in relation to the frame 100. FIG. 4 illustrates the movable member 200 according to one embodiment. As shown in FIG. 4, the movable member 200 comprises a body 201 defining a pair of laterally oriented slits 202. The strap 300 can be threaded through the slits 202 such that the movable member 200 to acts as a buckle securing a portion of the strap 300 to the frame 100.

The movable member 200 also includes a pair of lateral flanges 203 extending outwardly from the lateral sides of the movable member's body 201. The flanges 203 each define a tooth 205 projecting outwardly from the front surface of each respective flange 203. In the illustrated embodiment, each tooth 205 includes a pair of angled walls extending towards a flattened top edge. The flanges 203 and teeth 205 are configured to engage portions of the frame's channel 112 in order to control the movement of the movable member 200.

Referring back to FIG. 2, the frame's channel 112 includes a plurality of inner mating teeth 118 defined along the interior of the channel's lateral edges. The mating teeth 118 extend inwardly toward the frame's rear wall 114 and are dimensioned to define a gap between the edges of the mating teeth 118 and the rear wall 114. As shown in FIG. 2, the movable member 200 is positioned within the channel 112 such that its lateral flanges 203 extend into the gaps defined between the rear wall 114 and inner mating teeth 118. As a result of the thickness of the flanges 203 in relation to the gaps, the movable member's teeth 205 engage the mating teeth 118 on both sides of the channel 112.

In particular, each of the movable member's teeth 205 is sized to fit between adjacent mating teeth 118. As such, when the movable member 200 is not subjected to a deliberate force pushing it upwardly or downwardly along the channel 112, the teeth 205 remain between adjacent mating teeth 118 and the movable member 200 remains in a fixed position. However, as a result of the each tooth's flattened top, the teeth 205 have a depth less than that of the mating teeth 118. In addition, the material used to construct the channel 112 and movable member 200 is semi-rigid and allows for some flexibility under loading. As a result, when a user exerts a deliberate force pushing the movable member 200 in a direction along the channel 112, the movable member's teeth 205 are forced out of their position between adjacent mating teeth 118 and move across the rows of mating teeth 118 until the force applied by the user is stopped. In addition, as described in greater detail below, when the strap 300 connected to the movable member 200 is secured around a support structure and tightened, the strap 300 generally exerts a force on the movable member 200 pulling it toward the channel's inner teeth 118. As a result, when the attachment device 2 is tightly secured to a support structure, the movable member 200 is more securely held against the inner teeth 118 and more resistant to movement along the channel 112.

The configuration of the channel 112 and the movable member 200 depicted in FIGS. 2 and 4 enables a user to adjust the position of the movable member 200 with respect to the frame by applying deliberate force, while ensuring that the movable member 200 remains in its set position absent a force from a user deliberately repositioning the movable member 200. However, this configuration represents only one embodiment of the device 2. As will be appreciated from the description herein, the movable member 200 may be connected to frame 100 by a variety of mechanisms configured to permit the movable member to be repositioned along the channel 112 by a user and secured in a user-preferred position. For example, in certain embodiments the movable member 200 is generally configured to freely slide along the channel 112 (e.g., via rails or ball bearings). In such embodiments, the movable member 200 is configured to be pulled against the edges of the channel 112 by the strap 300 (e.g., when the attachment device 2 is tightly secured to a support structure), thereby preventing movement of the movable member 200 along the channel 112. In one embodiment, the channel 112 and/or movable member 200 may include a surface comprising a high-friction material (e.g., rubber) configured to hold the position of the movable member 200 when it is pulled toward the channel 112 by the strap 300, while permitting movement of the movable member 200 when the strap 300 is not exerting a significant force.

According to various embodiments, the strap 300 is configured for being positioned around a support structure and secured to the frame 100 in order to attach the attachment device 2 to the support structure. The strap 300 generally comprises a flexible strip of material, such as nylon webbing or an elastic band, and is configured to be operatively connected to the frame 100 at two or more connection positions. In the illustrated embodiment of FIG. 1, a lower portion of the strap 300 is connected to the movable member 200. In particular, the strap 300 is threaded through the movable member's slits 202 (shown in FIG. 4) and clamped between the movable member 200 and the frame's rear wall 114 such that the lower portion of the strap 300 is connected to the movable member 200 and, operatively, to the frame 100.

In addition, an upper portion of the strap 300 is connected to the fastener 400. In the illustrated embodiment, the fastener 400 comprises a male end of a center release buckle and also includes a slide buckle 401 for securing the strap 300 to the fastener 400. In the illustrated embodiment, the upper portion of the strap 300 is threaded through the fastener's slide buckle 401, thereby connecting the strap 300 to the fastener 400. The fastener 400 is configured to releasably engage the frame's mating fastener 121, which defines a female end of a center release buckle in the embodiment of FIG. 1. As a result, when the fastener 400 is engaged with the frame's mating fastener 121, the strap 300 is releasably connected to the frame 100. Thus, the strap's connection to the movable member 200 defines a first connection position on the frame 100, while the strap's connection to the fastener 400 defines a second connection position on the frame 100.

As described in greater detail below, when the attachment device 2 is secured to a support structure, the portion of the strap 300 positioned between the fastener 400 and movable member 200 is mostly engaged with the support structure. Accordingly, in the illustrated embodiment of FIG. 1, the portion of the strap 300 positioned at any time between the fastener 400 and movable member 200 comprises an "effective portion" of the strap 300 having an "effective length." The attachment device 2 is configured such that the effective length of the strap 300 can be adjusted by a user via the fastener's slide buckle 401 and the movable member 200. For example, the slide buckle 401 acts as a length adjuster by permitting a user to adjust the effective length of the strap 300 by pulling the strap 300 in either direction through the slide buckle 401.

In addition, in embodiments in which the strap 300 is not stretchable, the position of the movable member 200 controls the minimum effective length of the strap 300 at any given time. In other words, when the strap 300 is connected to the frame 100 via the movable member 200 and fastener 400, the effective length of the strap 300 cannot be less than the distance between the movable member 200 and the fastener 400. As such, a user may reduce the strap's minimum effective length by moving the movable member 200 closer to the frame's mating fastener 121, and may increase the strap's minimum effective length by moving the movable member 200 further from the frame's mating fastener 121. As described in detail below, the adjustability of the strap's effective length and minimum effective length allow the attachment device 2 to be securely attached to support structures having a variety of cross-sectional shapes and sizes.

Securing the Accessory Attachment Device to a Support Structure

According to various embodiments, the attachment device 2 is configured for being attached to a children's support device, such as a crib, play yard, seat, or swing. In particular, the attachment device 2 is configured for being attached to a support structure portion of a support device, such as a crib railing, seat frame, or other structural component.

Figure 5:
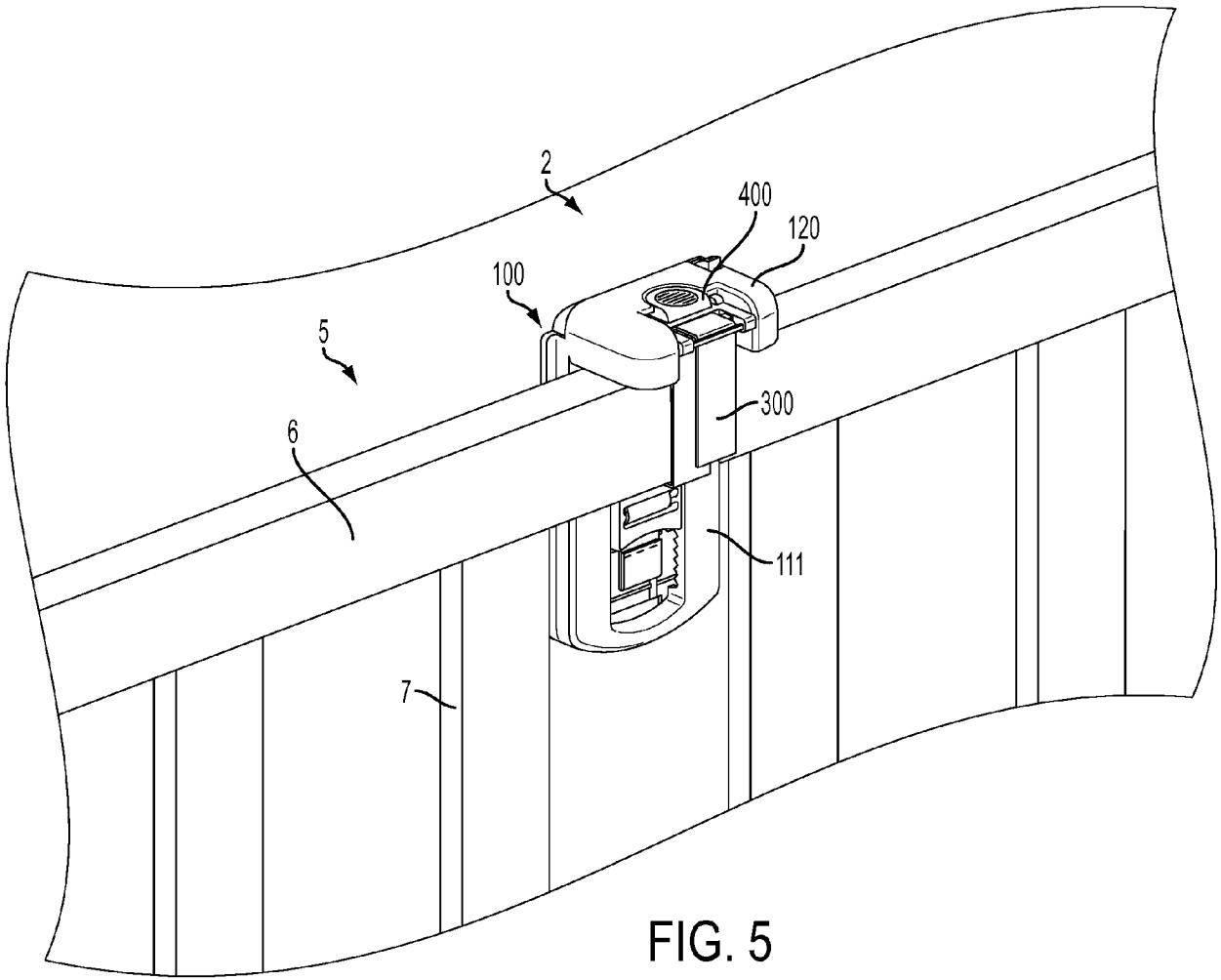
FIG. 5 shows a perspective view of an attachment device secured to the railing of a children's crib according to one embodiment of the present invention.
Figure 6:
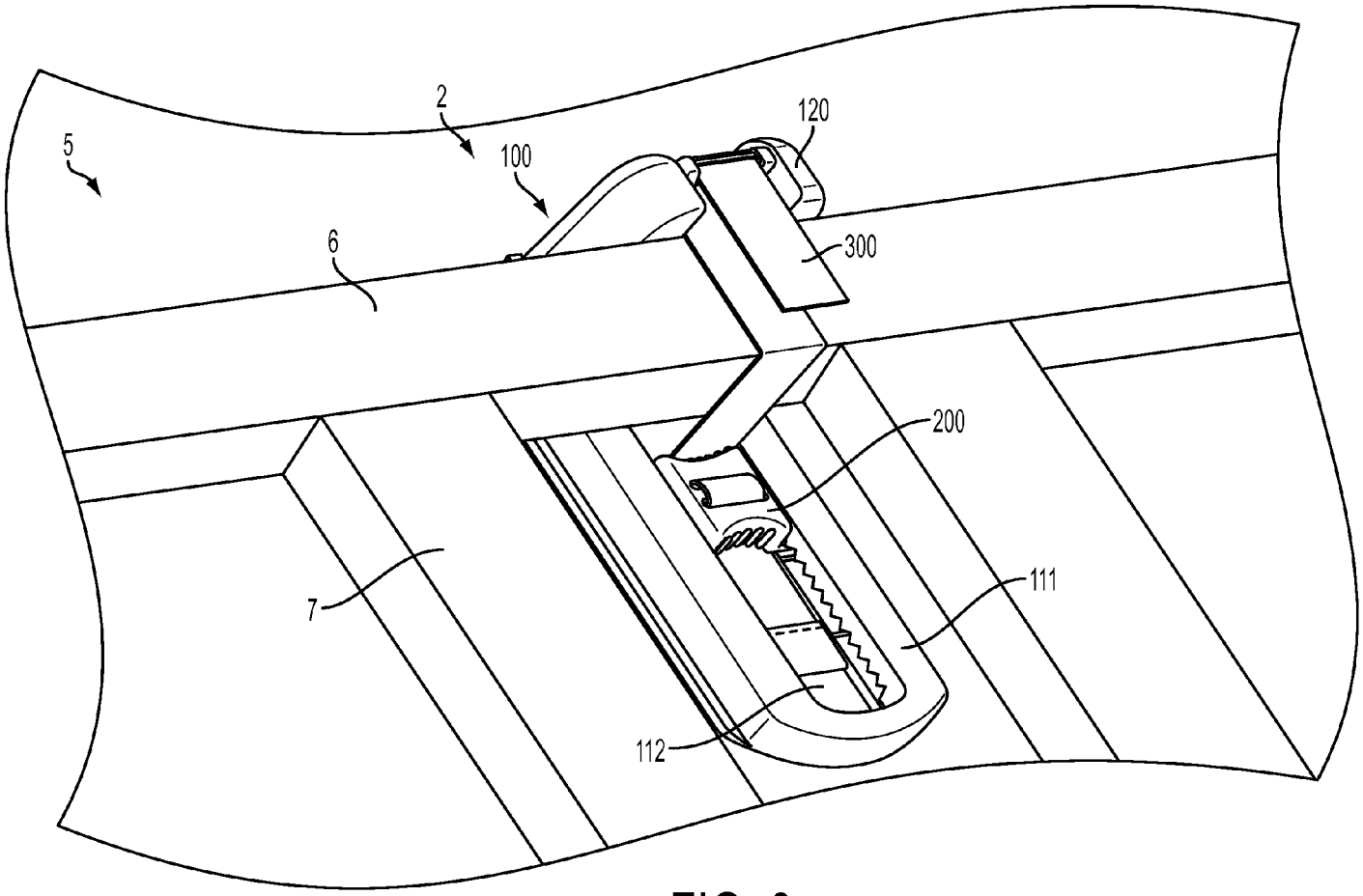
FIG. 6 shows another perspective view of the attachment device and children's crib of FIG. 5.

For example, FIGS. 5 and 6 illustrate the attachment device 2 attached a children's crib 5. In the illustrated embodiment, attachment device 2 is secured to the crib's upper railing 6 and is positioned between vertical railings 7. As shown in FIG. 5, the attachment device 2 can be attached to the crib railing 6 by first positioning the device 2 such that the intersection of the frame's front wall 111 and shelf 120 (i.e., the corner 123 shown in FIG. 2) is proximate an upper corner of the railing 6. In this position, the frame's shelf 120 rests on an upper surface of the railing 6, while the frame's front wall 111 abuts a side edge of the railing 6. Although not visible in FIG. 5, the shelf's bottom gripping surface 124 (shown in FIG. 2) is in contact with the upper surface of the railing 6.

Next, as shown in FIGS. 5 and 6, the attachment device's strap 300 is wrapped around the railing 6 such that its effective portion is positioned around the edges of the railing 6 opposite the frame's front wall 111 and shelf 120. The fastener 400 is then engaged with the frame's mating fastener 121 in order to secure the strap 300 to the frame 100. Next, as shown in FIG. 6, the movable member 200 is repositioned along the channel 112 such that it is proximate the bottom surface of the railing 6. By adjusting the position of the movable member 200 to be near the railing's bottom surface, the portion of the strap 300 proximate the movable member 200 is moved adjacent the bottom surface of the railing 6.

The strap 300 is next tightened around the railing 6 (e.g., by pulling the strap 300 through the slide buckle 401 and reducing the strap's effective length). As the strap 300 is tightened, the effective portion of the strap 300 pulls the frame 100 against the railing 6. As shown in FIG. 6, the position of the movable member 200 causes the strap 300 to grip the railing 6 along both its side edge and its bottom surface. Indeed, if the movable member 200 were positioned distally from the bottom surface of the railing 6, the strap 300 would grip the side edge of the railing 6 and extend downwardly toward the movable member 200, out of contact with the railing's bottom surface. Thus, adjustment of the movable member 200 results in greater contact between the strap 300 and the railing 6, and enables secure attachment of the attachment device 2 to the railing 6.

In certain embodiments, the movable member 200 may be configured such it automatically moves along the channel 112 towards a proximate surface of a support structure when the strap 300 is tightened. For example, as described above, the movable member 200 may be secured to the channel 112 such that it is permitted to move freely along the channel 112 when it is not being pulled toward the channel 112 by the strap 300. In such embodiments, the attachment device 2 may be configured such that, when the strap 300 is secured around a support structure (e.g., the crib railing 6) and tightened, the force of the strap 300 being tightened initially pulls the movable member 200 along the channel 112 toward a proximate surface of the support structure (e.g., the bottom surface of the crib railing 6). Once the movable member 200 reaches the proximate surface, the force of the strap 300 being tightly secured around the support structure holds the movable member in place. In such embodiments, the user is not required to manually adjust the position of the movable member 200.

As will be appreciated from the description herein, the attachment device 2 can be secured to support structures having a variety of cross-sectional shapes and sizes, Such structures include, but are not limited to, support structures having circular, rectangular, or triangular cross-sections, structures having non-symmetrical cross-sections, and structures having convex and/or concave surfaces. In particular, the ability to adjust the position of the movable member 200 in relation to the frame and to adjust the effective length of the strap 300 enables the device 2 to be reconfigured for a particular support structure every time it is attached. This ability enables the device 2 to act as a universal attachment device for use with various types of children's support devices.

In addition, the attachment device 2 can be secured in other orientations relative to a support device. For example, in the illustrated embodiment of FIGS. 5 and 6, the attachment device 2 is secured to an inner edge of the railing 6 (e.g., an edge facing the interior of the crib 5). However, according to various embodiments, the attachment device 2 may also be secured to an outer edge of the railing 6 (e.g., an edge facing away from the interior of the crib 5). In addition, the attachment device 2 could be secured to the crib's vertical railings 7 (e.g., such that the frame's front wall 111 is generally oriented perpendicularly to the vertical railing 7).

Securing a Removable Accessory to the Accessory Attachment Device

According to various embodiments, the attachment device 2 is configured to be used interchangeably with a variety of children's accessories, such as mobiles, audio-visual devices, and other accessories used in connection with children's support devices. In particular, the attachment device 2 is configured to removably secure a children's accessory to its frame 100 as it is attached to the support structure of a children's support device, in effect securing the accessory to the support device.

Figure 7:
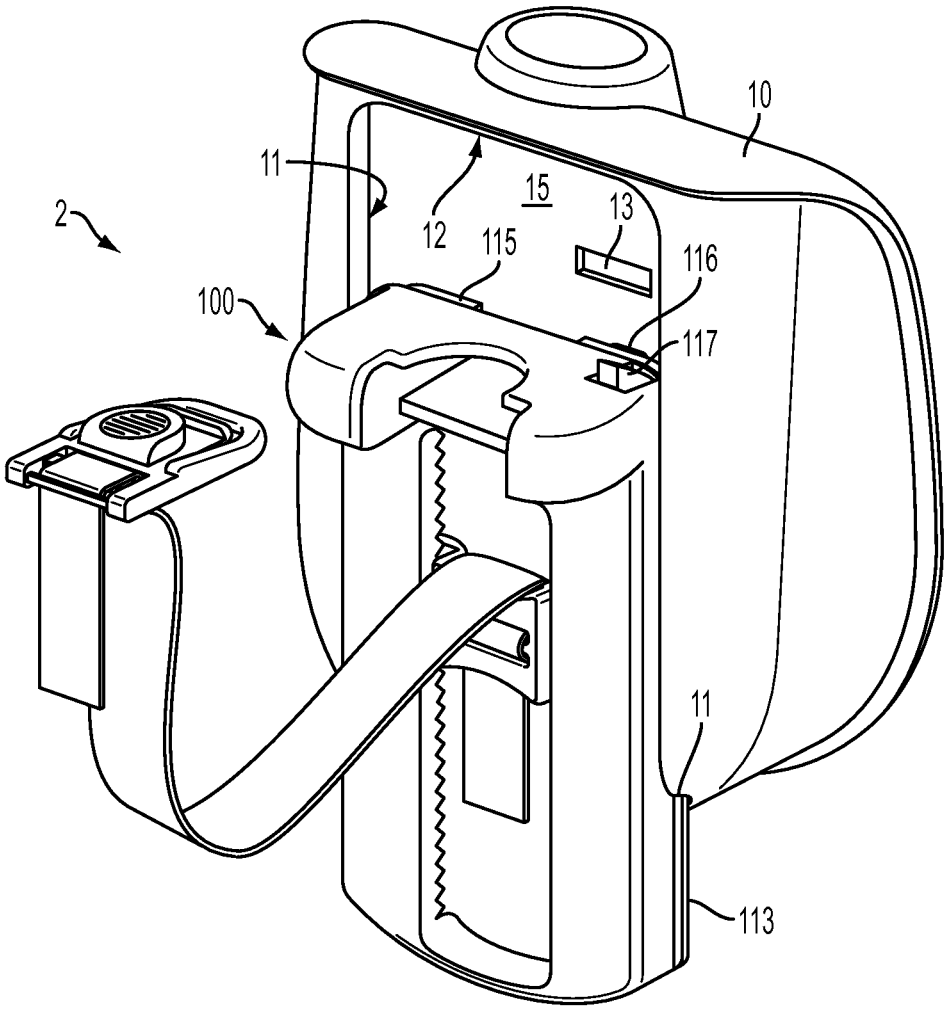
FIG. 7 shows a perspective view of an attachment device and a children's accessory housing according to one embodiment of the present invention.

For example, FIG. 7 illustrates a children's accessory housing 10 being secured to the attachment device 2 according to one embodiment. In the illustrated embodiment, the housing 10 includes a front wall 15 defining a pair of lateral channels 11. The housing 10 further includes a shelf 12 extending outwardly from the front wall 15, and a recessed portion in the front wall 15 defining a ledge 13.

To secure the housing 10 to the attachment device 2, the housing 10 is first positioned above the attachment device's frame 100 such that its channels 11 are aligned with the frame's lateral flanges 113. As shown in FIG. 7, the housing 10 is then lowered onto the frame 100 such that the frame's lateral flanges 113 are inserted into the housing's channels 11 and the housing's front wall 15 abuts the frame's rear wall 114 (shown in FIG. 3). As the housing 10 is lowered, the housing's front wall 15 pushes the spring-loaded finger 116 of the frame's locking mechanism inward. When the housing 10 is fully engaged with the frame 100, the housing's shelf 12 will contact the frame's landing surfaces 115, thereby preventing the housing 10 from being lowered further. At this point, the housing's recessed portion will become aligned with the spring-loaded finger 116, thereby causing the outwardly-biased finger 116 to extend into the recessed portion and over the ledge 13.

When the housing 10 is fully engaged with the frame 100, the frame's lateral flanges 113 prevent the housing 10 from moving laterally, the frame's landing surfaces 115 prevent the housing 10 from moving downwardly, and the finger 116 prevents the housing 10 from moving upwardly. As such, the housing 10 can be fully secured to the attachment device 2. To remove the housing 10 from the attachment device, a user may press the release member 117 of the frame's locking mechanism outward. This action retracts the locking mechanism's finger 116, thereby disengaging the finger 116 from the housing's ledge 13 and freeing the housing 10 to be lifted upwardly off of the attachment device 2.

Figure 8:
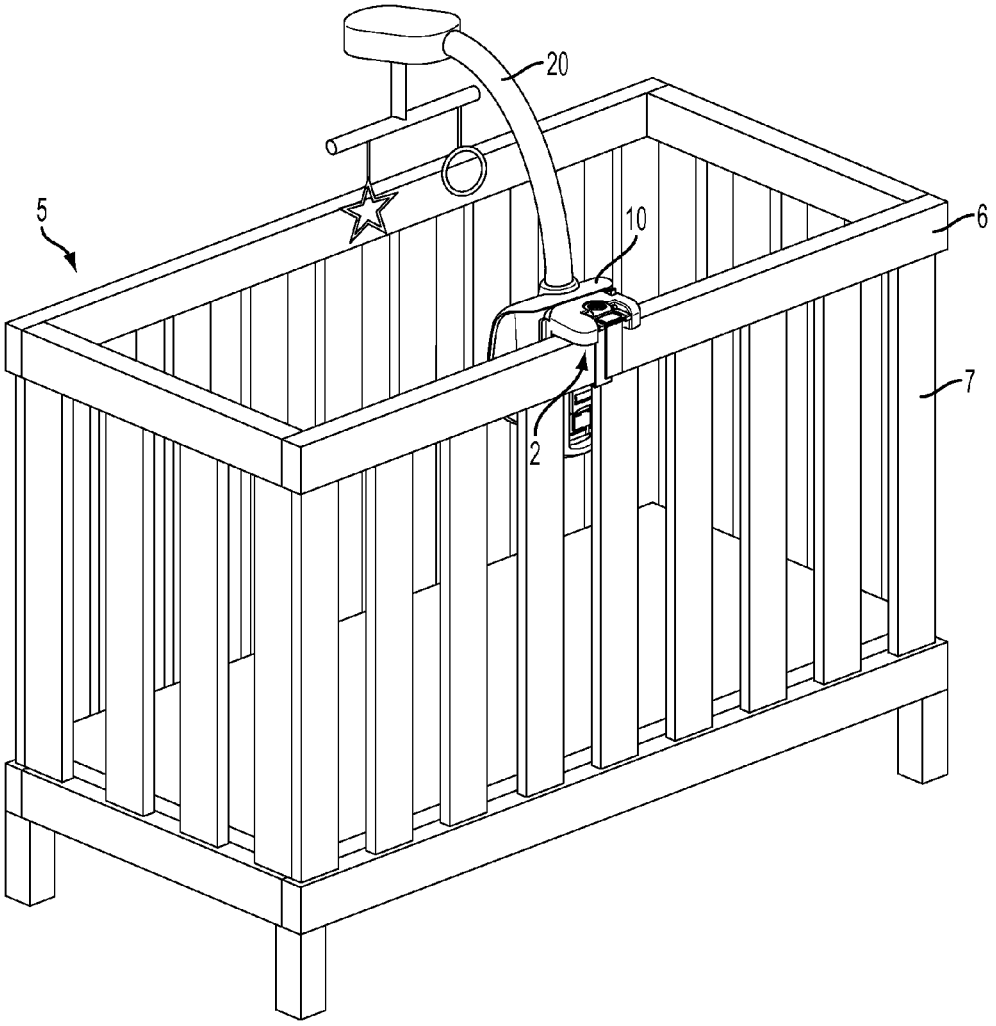
FIG. 8 shows a perspective view of a children's mobile accessory, an attachment device, and a children's crib according to one embodiment of the present invention.

FIG. 8 illustrates the housing 10 as it supports a children's mobile 20 and is attached to a crib 5 via the attachment device 2. As is evident from the FIG. 8, the weight of the children's accessory 10, 20 is fully supported by the attachment device 2. In addition, as will be appreciated from FIG. 8 and the description above, the children's accessory 10, 20 can be attached and/or removed from the attachment device 2 while the attachment device 2 remains secured to the crib's railing 6. As a result, various children's accessories configured to engage the attachment device 2 can be easily interchanged without the need to remove the attachment device 2 from the crib 5.

Various Embodiments of the Attachment Device

In addition to the embodiments described above in relation to FIGS. 1-8, various other embodiments of the attachment device 2 are also contemplated. For example, the strap 300 may be connected to the frame 100 in a variety of ways. In certain embodiments, one end of the strap 300 is connected to an upper portion the frame 100 (e.g., via a buckle positioned on the shelf 120) and an opposite end of the strap 300 is connected to a fastener configured to engage a mating fastener defined on the movable member 200. In another embodiment, both ends of the strap 300 are secured to fasteners, one of which is configured to engage a mating fastener on an upper portion of the frame and the other configured to engage a mating fastener defined on the movable member 200. In yet another embodiment, the strap 300 comprises a first strap connected to the movable member 200 at one end and a first mating fastener at an opposite end, and a second strap connected to an upper portion of the frame 100 at one end and a second mating fastener at an opposite end. In this embodiment, the first and second mating fasteners may be engaged in order to connect the first and second straps to one another.

In certain embodiments, the attachment device 2 may not include a movable member 200. In such embodiments, the strap 300 may be connected to upper and lower portions of the frame 100. In other embodiments, the attachment device 2 may include a plurality of straps connected to frame 100 at various connection positions. As will be appreciated from the description herein, in each of the aforementioned configurations, the one or more straps provided on the attachment device 2 are configured to be releasably secured around a support structure in order to attach the frame 100 to a support structure.

According to various other embodiments, the fastener 400 may comprise a snap fastener, magnetic fastener, hook and loop fastener, clasp, or various buckles. Furthermore, various embodiments of the mating fastener 121 may be configured to engage the various embodiments of the fastener 400 and may be defined as part of the frame 100 structure, or may be a separate member connected to the frame 100.

In addition, the various features of the frame 100 may differ according to other embodiments. According to various embodiments, the frame 100 may be constructed from any material of suitable strength for supporting a children's accessory, including plastics, other polymer materials, and metals. In addition, various features of the frame 100, such as the walls 111, 114 and shelf 120, may be formed from a single material part or may be comprised of separate, joined parts. In certain embodiments, the frame 100 may not include the shelf 120. In embodiments lacking a shelf, the mating fastener 121 may be relocated to an upper portion of the frame's front wall 111. In other embodiments, the frame 100 may include more than one shelf extending outwardly from the frame 100. In certain embodiments, the frame's shelf 120 may not include a gripping surface 124. In further embodiments, a gripping surface may be provided on the frame's front wall 111.

The coupling features on the rear area of the frame 100 may also be modified. For example, in certain embodiments, the flanges 113 may be provided on non-lateral portions of the rear wall 114. In a particular embodiment, the frame may include an I-beam flange extending outwardly from the rear wall 114. In other embodiments, the coupling features comprise one or more fasteners affixed to the frame's rear wall 114, such as magnets, hook and loop fasteners, snaps, claps, or buckles. These fasteners may be configured to engage corresponding mating fasteners provided on a children's accessory in order to secure the accessory to the attachment device 2.

Figure 9:
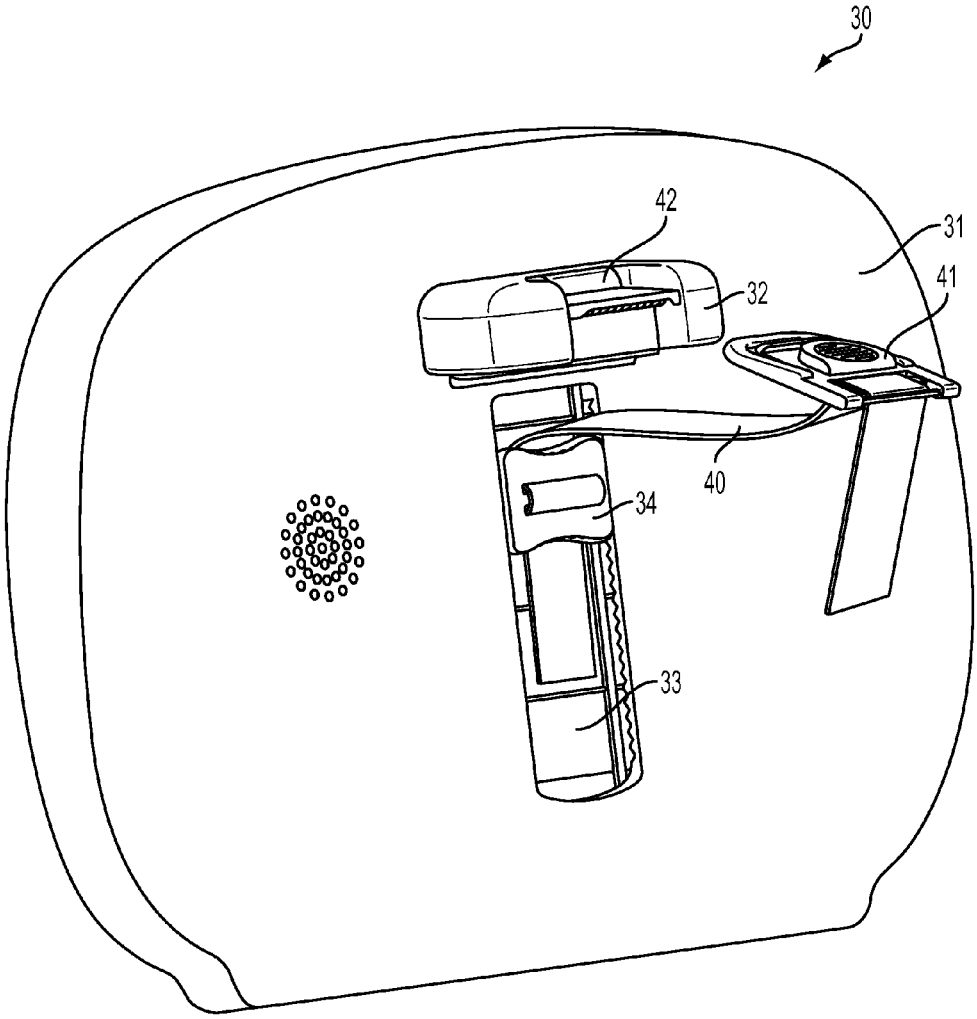
FIG. 9 shows a perspective view of a children's accessory having an integrated attachment device according to one embodiment of the present invention.

In other embodiments, the attachment device 2 may not include coupling features for securing an accessory. For example, in certain embodiments, the attachment device's frame comprises the housing of a children's accessory. In such embodiments, the features of the attachment device 2 may be provided directly on the accessory's housing. FIG. 9 illustrates a noise-making children's accessory 30 configured for attachment to a support structure. As shown in FIG. 9, the accessory 30 includes a housing defining a front wall 31, an outwardly projecting shelf 32, and a longitudinal channel 33. The accessory 30 further includes a movable member 34 configured for movement along the channel 33, a strap 40 connected to the movable member 34, and a fastener 41 connected to the strap 40 and configured to engage a mating fastener 42 defined on the shelf 32. As such, the accessory 30 may be directly attached to a support structure (e.g., the crib railing 6 of FIGS. 5, 6, and 8) using the techniques described above in relation to the attachment device 2.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An attachment device for attaching a children's accessory to a support structure, the attachment device comprising:

a frame defining a front wall and a frame shelf extending outwardly from the front wall, the frame shelf being configured such that a bottom surface of the frame shelf engages an upper portion of the support structure when the attachment device is attached to the support structure;

at least one strap operatively connected to the frame at a first connection position and a second connection position, wherein the portion of the strap positioned between the first connection position and the second connection position defines an effective portion of the strap having an effective length;

at least one fastener connected to the strap, wherein the at least one fastener is configured for releasably securing the effective portion of the strap around a portion of the support structure in order to attach the attachment device to the support structure; and at least one movable member connected to the frame and connected to the strap, wherein the position of the movable member defines the location of the first connection position, wherein the movable member is configured for being moved along at least a portion of the frame to a preferred position with respect to the support structure, and wherein the strap's effective length can be adjusted to effectively attach the children's accessory to the support structure.

2. The attachment device of claim 1, wherein the movable member is configured to slide along a longitudinal axis of the frame.

3. The attachment device of claim 2, wherein the frame defines a longitudinal channel having a plurality of inner teeth;

wherein the movable member includes a pair of lateral flanges defined on lateral sides of the movable member, each of the lateral flanges defining one or more teeth configured to engage the inner teeth of the frame's longitudinal channel; and wherein the movable member is positioned at least partially within the channel and is configured to slide along the longitudinal channel upon application of deliberate force by a user and to remain secured in a user-preferred position absent such deliberate force.

4. The attachment device of claim 2, wherein the movable member is configured such that, in response to the strap being secured around the support structure and tightened, the movable member slides to a position adjacent a surface of the support structure.

5. The attachment device of claim 1, further comprising at least one length adjuster connected to the strap, the length adjuster being configured to enable a user to adjust the strap's effective length.

6. The attachment device of claim 5, wherein the length adjuster comprises a slide buckle, and wherein the strap is threaded through the slide buckle.

7. The attachment device of claim 1, wherein the position of the movable member defines a minimum effective length of the strap.

8. The attachment device of claim 1, wherein the at least one fastener comprises a first mating fastener and a second mating fastener, the first mating fastener being connected to the strap and the second mating fastener being defined on the frame at the second connection position;

wherein the first mating fastener and second mating fastener are configured for being engaged in order to releasably connect the strap to the frame at the second connection position.

9. The attachment device of claim 1, wherein the at least one fastener comprises a first mating fastener and a second mating fastener, the first mating fastener being connected to the strap and the second mating fastener being defined on the movable member at the first connection position; and wherein the first mating fastener and second mating fastener are configured for being engaged in order to releasably connect the strap to the movable member at the first connection position.

10. The attachment device of claim 1, wherein the at least one strap comprises a first strap connected to the movable member at the first connection position and a second strap connected to the frame at the second connection position;

wherein the at least one fastener comprises a first mating fastener connected to the first strap and a second mating fastener connected to the second strap; and wherein the first mating fastener and second mating fastener are configured or being engaged in order to releasably connect the first strap to the second strap.

11. The attachment device of claim 1, wherein the at least one fastener comprises a center release buckle.

12. The attachment device of claim 1, wherein the bottom surface of the frame shelf includes a gripping surface.

13. The attachment device of claim 12, wherein the gripping surface comprises a ribbed rubber strip affixed to the bottom surface of the frame shelf.

14. The attachment device of claim 1, wherein the frame defines one or more coupling features configured for engaging the children's accessory and releasably securing the children's accessory to the attachment device.

15. The attachment device of claim 1, wherein the frame comprises a children's accessory housing.

16. An attachment device for attaching a children's accessory to a support structure, the attachment device comprising:

a frame defining a front wall and a frame shelf extending outwardly from the front wall, the frame shelf being configured such that a bottom surface of the frame shelf engages an upper portion of the support structure when the attachment device is attached to the support structure;

at least one strap operatively connected to the frame; and at least one fastener connected to the strap, wherein the at least one fastener is configured for releasably securing the strap around a portion of the support structure in order to attach the frame to the support structure;

wherein the frame defines one or more coupling features configured for engaging the children's accessory and removably securing the children's accessory to the attachment device.

17. The attachment device of claim 16, wherein the one or more coupling features comprise one or more flanges extending longitudinally along the frame.

18. The attachment device of claim 17, wherein the one or more flanges comprise a first lateral flange and a second lateral flange, the first and second lateral flanges extending outwardly from lateral sides of the frame; and wherein the one or more coupling features further comprise one or more landing surfaces defined on the frame.

19. The attachment device of claim 16, wherein the frame includes at least one accessory locking mechanism.

20. The attachment device of claim 19, wherein the at least one accessory locking mechanism comprises a spring-loaded finger biased to extend outwardly from a rear wall of the frame.

21. The attachment device of claim 16, wherein the one or more coupling features comprise one or more fasteners.

22. A children's accessory and attachment device configured for attachment to a support structure, the children's accessory and attachment device comprising:

a children's accessory comprising a housing; and an attachment device configured for being attached to the support structure and for receiving and supporting the housing, the attachment device comprising:

a frame;

at least one strap operatively connected to the frame; and at least one fastener connected to the strap, wherein the at least one fastener is configured for releasably securing an effective portion of the strap around a portion of the support structure in order to attach the attachment device to the support structure;

wherein the frame defines one or more coupling features configured for engaging the housing and removably securing the children's accessory to the attachment device.

23. The children's accessory and attachment device of claim 22, wherein the accessory's housing defines one or more longitudinal channels; and wherein the one or more coupling features comprise one or more flanges extending longitudinally along the attachment device's frame, the one or more flanges being configured to be received within the longitudinal channels, thereby coupling the housing to the attachment device.

24. The children's accessory and attachment device of claim 22, wherein the housing's one or more longitudinal channels define a first longitudinal channel and a second longitudinal channel;

wherein the housing further defines a shelf;

wherein the attachment device's one or more flanges comprise a first lateral flange and a second lateral flange, the first and second lateral flanges extending outwardly from lateral sides of the attachment device's frame and being dimensioned to be received within the first longitudinal channel and second longitudinal channel, respectively; and wherein the attachment device's frame further defines one or more landing surfaces, the landing surfaces configured to engage the housing's shelf and support the housing when the housing is coupled to the attachment device.

25. The children's accessory and attachment device of claim 22, wherein the attachment device's frame includes at least one locking mechanism configured to selectively secure the accessory's housing to the attachment device.

26. The children's accessory and attachment device of claim 25, wherein the accessory's housing defines a front wall having a ledge; and wherein the locking mechanism comprises a spring-loaded finger biased to extend outwardly from a rear wall of the frame, the finger configured to engage the housing's ledge when the housing is fully engaged with the attachment device and to selectively prevent the housing from being removed from the attachment device.

27. The children's accessory and attachment device of claim 22, wherein the accessory's housing includes one or more fasteners; and wherein the frame's one or more coupling features comprise one or more mating fasteners configured to engage the housing's one or more fasteners and removably secure the housing to the attachment device.

28. The children's accessory and attachment device of claim 22, wherein the children's accessory is configured for being fully removed from the attachment device, and wherein the attachment device is configured for engaging and removably securing another children's accessory.

29. An attachment device for attaching a children's accessory to a support structure, the attachment device comprising:

a frame comprising a children's accessory housing;

at least one strap operatively connected to the frame at a first connection position and a second connection position, wherein the portion of the strap positioned between the first connection position and the second connection position defines an effective portion of the strap having an effective length;

at least one fastener connected to the strap, wherein the at least one fastener is configured for releasably securing the effective portion of the strap around a portion of the support structure in order to attach the attachment device to the support structure; and at least one movable member connected to the frame and connected to the strap, wherein the position of the movable member defines the location of the first connection position, wherein the movable member is configured for being moved along at least a portion of the frame to a preferred position with respect to the support structure, and wherein the strap's effective length can be adjusted to effectively attach the children's accessory to the support structure.

* * * * *